US005870786A

United States Patent [19]

Papadopoulos

[11] Patent Number: 5,870,786

[45] Date of Patent: Feb. 16, 1999

[54] UTILITY TOOL

[76] Inventor: George N. Papadopoulos, 27 Grandview Ave., Norwalk, Conn. 06850

[21] Appl. No.: 871,328

[22] Filed: Jun. 9, 1997

Related U.S. Application Data

[63] Continuation of Ser. No. 535, Sep. 28, 1995.

[51] Int. Cl.[6] ..... B44C 7/00

[52] U.S. Cl. ..... 7/105; 7/165

[58] Field of Search ..... 7/105, 165, 436, 7/460; 81/450

[56] References Cited

U.S. PATENT DOCUMENTS

| | | | |
|---|---|---|---|
| 652,093 | 6/1900 | Diener | 7/105 |
| 898,568 | 9/1908 | Emmerson | 7/105 |
| 1,230,173 | 6/1917 | Kremer | 81/450 |
| 1,598,420 | 8/1926 | Brossett | 7/105 |
| 2,141,072 | 12/1938 | Velepec | 81/436 |
| 2,213,071 | 8/1940 | Keller | 7/105 |
| 4,327,790 | 5/1982 | Stevens et al. | 81/450 |
| 5,063,627 | 11/1991 | Marra | 7/105 |
| 5,251,352 | 10/1993 | Cullison | 7/105 |
| 5,553,340 | 9/1996 | Brown, Jr. | 7/165 |
| 5,575,030 | 11/1996 | Girard | 7/105 |

*Primary Examiner*—David A. Scherbel
*Assistant Examiner*—Joni B. Danganan
*Attorney, Agent, or Firm*—Handal & Morofsky

[57] ABSTRACT

The present disclosure is directed to a multipurpose tool for painters and/or the like. The tool allows for individual use of several basic tools while remaining versatile and compact. The tool comprises a blade, with a scraper edge, a pointed end, a square end, a concave surface, and a nail pulling means. The tool handle has rotatably mounted screwdriver attachments, each of which locks into a position through the use of an urging means, and a hammer head means substantially located on the aft end.

26 Claims, 8 Drawing Sheets

UTILITY TOOL

This application is a continuation of application Ser. No. 08/535,486, filed 28 Sep., 1995 now abandoned.

TECHNICAL FIELD

The present invention relates to a multipurpose tool for use in the painting and/or restoration field.

BACKGROUND

A multi-function painter's tool has become an essential tool of the trade in the painting and construction fields. The optimum tool is one that combines the features of several basic tools into one device because of limited dexterity when standing on a ladder. Several attempts have been made to construct such a tool without compromising the usefulness of the basic tools incorporated therein. However, most attempts have resulted in a basic core device with a numerous appendages. Such a device lacks the simplicity of the desired tool.

Naturally, the basic painter's utility tool is a time saving device which allows the painter to proceed undaunted through his project without wasting time looking for a screwdriver or the like to perform a simple task such as, removing a switch plate cover. The optimum utility tool is one that addresses the painter's various tool requirements while remaining compact and extremely portable. For instance, a painter must use several basic tools while he is painting or preparing a surface for painting. However, once in the middle of a project the painter, while performing a required task, may require the use of a scraper, nail puller, screw driver, roller cleaner, hammer or any combination thereof.

Since a painter is sometimes required to be extremely mobile by either walking on scaffolding or climbing a ladder it is not practical for a painter to carry each one of these tools on his body. In addition, it is not very cost effective for the same painter to waste time climbing up and down a ladder to search for a specific tool. Moreover, the same tool unless carried on his body may be lost again thereby wasting additional time searching for the same tool.

The present invention is concerned with this very problem. More particularly, the present invention is concerned with incorporating the most frequently required tools into a single device which a painter can quickly and efficiently utilize while performing his tasks. Thus, the present invention allows the painter to proceed unhindered through his job.

As might be expected, there is no shortage of utility tools for use in the construction field and more particularly the painting field. For example, U.S. Pat. No. 5,272,788, issued to Hutt, discloses a multipurpose painter's tool having a flat scraper, a collar part and a comb.

U.S. Pat. No. 5,228,159, issued to Gurka, discloses a combination tool for painters. This tool comprises a single elongated rigid device with bends, apertures and incisions on it.

U.S. Pat. No. 699,207, issued to Moe is directed to a three way combination tool comprising a scraper, locking screwdriver and claws. See also U.S. Pat. No. 3,774,252, issued to Cantales is drawn to a spackling knife tool which performs the functions of a spackling knife, a nail puller, and a screwdriver.

There are also many other multipurpose tools. U.S. Pat. No. 3,562,826, issued to Vaughn is directed to a multipurpose tool comprising a handle, hammering means, scraper, nail pulling means, and a magnet. U.S. Pat. No. 898,568, issued to Emmerson discloses a calciminer's knife with an improvement for removing nails. U.S. Pat. No. 5,063,627, issued to Marra discloses a tapping blade with a handle that includes a hammering surface and rotatably mounted screwdriver blades.

From the above, it can be seen that none of the above patents disclose a portable device which provides the user with a quick and efficient combination tool that is simple to use and suitable for use in solving the common problems encountered while painting.

U.S. Pat. No. 5,251,352, issued to Cullison, discloses a device which attempts to address these deficiencies. Cullison discloses a seven way combination tool for allowing separate use of each functional portion. He utilizes a central blade which has a beveled end and concave surface opposite the tool handle. The tool handle is comprised of upper and lower portions which are rotable. The handle portions have openings which accommodate screwdriver heads. However, the use of the screwdriver heads is extremely limited and the combination design inhibits the use of the paint scraper aspect of the tool. In addition, the Cullinson device lacks the means for pulling out nails, and a hammer head type end.

SUMMARY OF THE INVENTION

The invention, as claimed, is intended to provide a remedy. It solves the problem of how to benefit from the use of several tools generally required in the painting field without carrying a plethora of separate tools.

It is an object of this invention is to incorporate the required tools into a single device without detracting from their usefulness. The invention contemplates a novel invention which greatly reduces the amount of time wasted searching for the proper tool. Another object of this invention is to provide an efficient structure capable of performing the functionalities of the tool involved in a convenient and easy to use device for use while working from a ladder, scaffolding or the like.

BEST MODE FOR CARRYING OUT THE INVENTION

A painter's utility tool 10 constructed in accordance with the present invention is illustrated in FIGS. 1–8.

Figure 1:
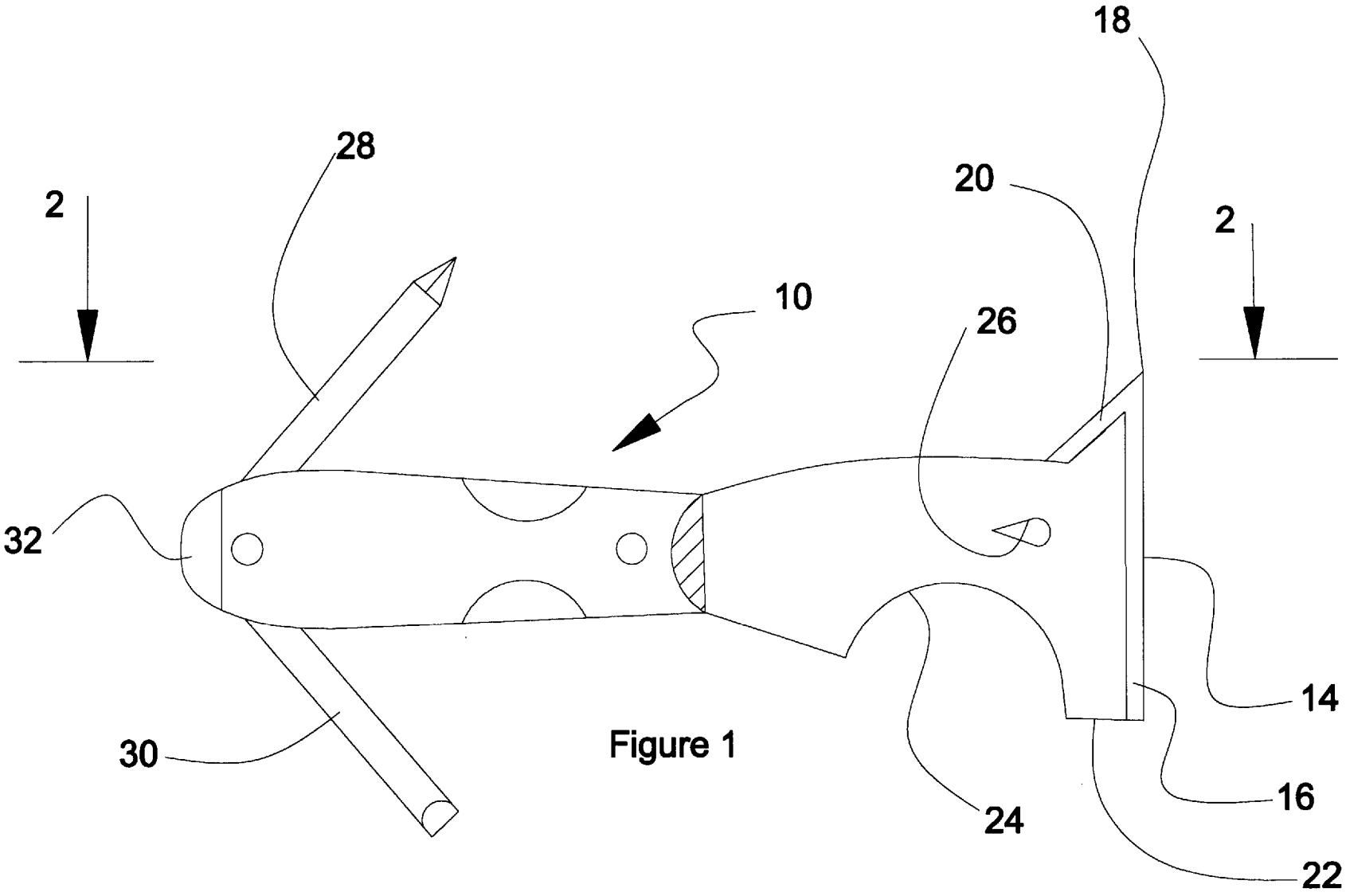
FIG. 1 is a top plan view of the preferred embodiment of the multipurpose tool constructed in accordance with the present invention.

As can be seen in FIG. 1, utility tool 10 has a blade 12. Blade 12 is provided with a scraper edge 14. Scraper edge 14 is beveled on a side 16 to provide a sharp scraping surface. Scraper edge 14 can be utilized to prepare a surface for painting by scraping flaking paint chips off of a surface to be painted.

Blade 12 also contains a pointed edge 18. Pointed edge 18 is also beveled on a side 20 to provide a sharp surface. Pointed edge 18 provides a means for glazing or puncturing a perforated paint container.

Blade 12 also has a square edge 22. Square edge 22 provides a means for prying open a paint container and/or performing a similar function while preparing an area for painting such as, prying a screen out from a storm window.

Blade 12 also has a concave edge surface 24. Concave edge surface 24 serves as a paint roller cleaner, whereby, the user can scrap excess paint off of a roller.

The surface of blade 12 has a hole 26 through it. Hole 26 provides utility tool 10 with a nail extracting means. Hole 26 allows the user to extract nails from the surface of the area being painted and/or scraped.

Blade 12 also incorporates a pivotally mounted Phillips head screwdriver 28, and a pivotally mounted standard head screwdriver 30. Finally, a hammer head end 32 is also provided.

Figure 2:
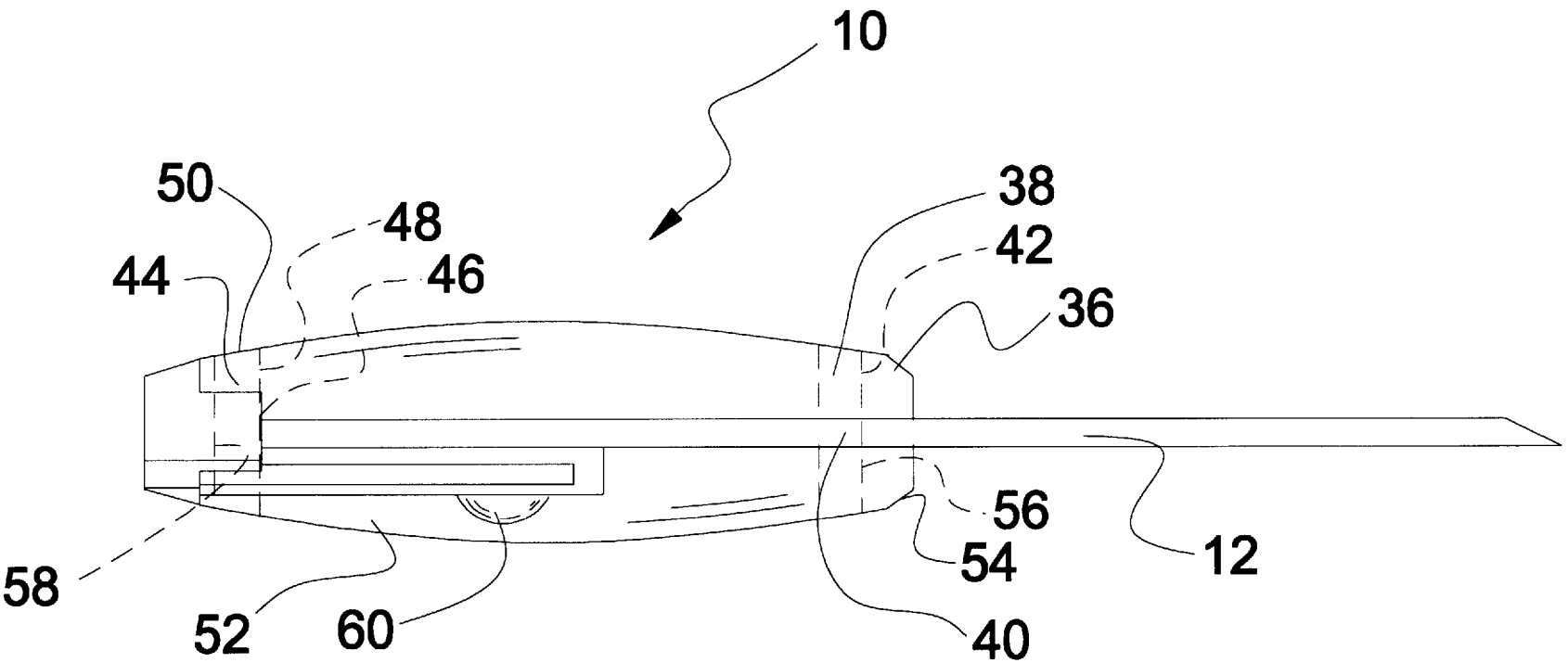
FIG. 2 is a side view along lines 2—2 of the embodiment illustrated in FIG. 1, but with the screwdrivers rotated into the handle of the tool.

Referring in particular to FIG. 2, blade 12 which is preferably metal, extends throughout the entire length of utility tool 10. To provide for an adequate gripping surface, blade 12 has an upper handle grip 34 and a lower handle grip 52 mounted on blade 12.

Upper handle grip 34 has a beveled end 36 to provide an adequate gripping configuration. Upper handle grip 34 is mounted on blade 12 through the use of a pin 38. Pin 38 passes through a hole 40 in blade 12 and then extends into a hole 42 in upper handle grip. In addition to pin 38, a cylinder 44 is also used to mount upper handle grip to blade 12. Cylinder 44 passes through a hole 46 in blade 12 and then extends into a hole 48 in upper handle grip 34.

Cylinder 44 further defines a hole 50 which extends through the end portion of utility tool 10. Hole 50 can be used as a means for fastening utility tool 10 to the belt of the user or some other convenient location. This feature allows the user to hang the utility tool from a belt loop or some other convenient location whereby the user can readily have immediate access to it.

Lower handle grip 52 also has a beveled end 54 to provide an adequate gripping configuration. Lower handle grip 52 is also mounted on blade 12 through the use of pin 38. Pin 38 passes through a hole 40 in blade 12 and then extends into a hole 56 in lower handle grip 52. In addition to pin 38, cylinder 44 is also used to mount lower handle grip to blade 12. Cylinder 44 passes through a hole 46 in blade 12 and then extends into a hole 58 in lower handle grip 52.

Figure 3:
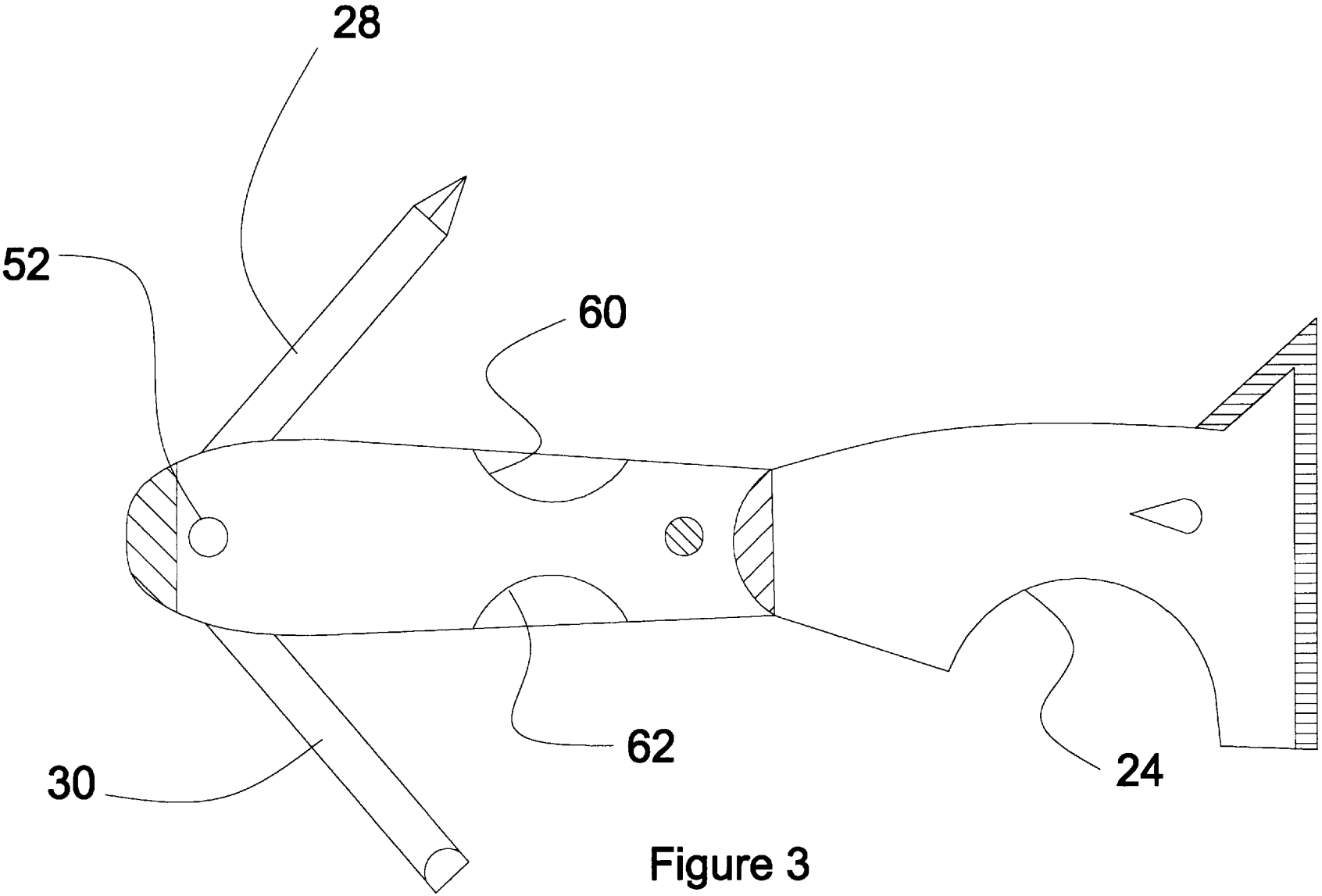
FIG. 3 is a bottom view of the embodiment illustrated in FIG. 1.

Referring now to FIG. 3 lower handle grip 52 also has access detents 60 and 62 to provide the user with access to pivotally mounted screwdrivers 28 and 30.

Upper and lower grips 34 and 52 can be constructed of a durable material such as plastic and/or wood which is easily manufactured in a variety of configurations.

Figure 4:
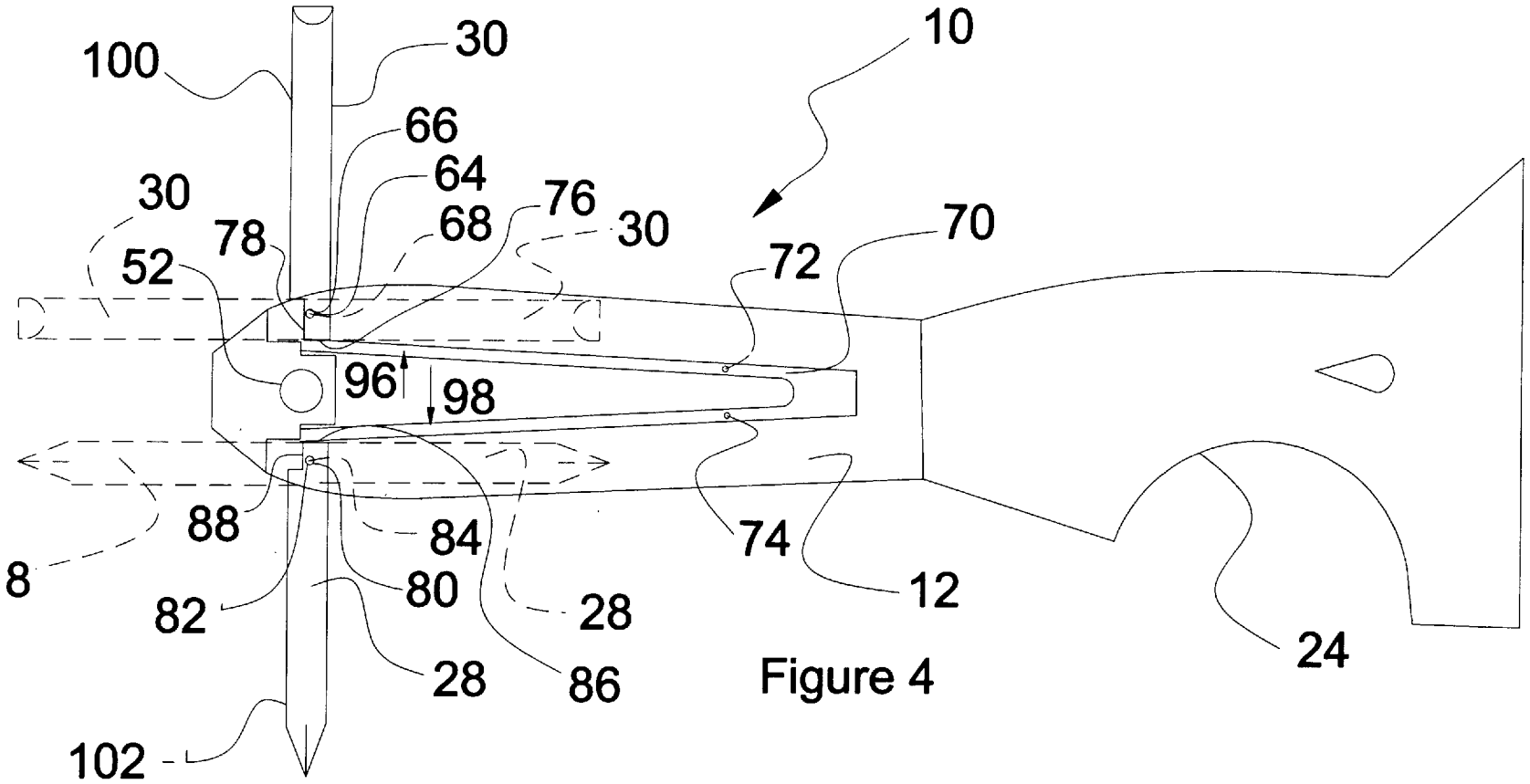
FIG. 4 is a bottom view of the embodiment illustrated in FIG. 1 with the lower handle grip removed.

Referring now to FIG. 4, a plan view blade 12 of the present invention is illustrated without lower handle portion 52. As most clearly illustrated in FIG. 4, screwdriver attachments 28 and 30 are pivotally mounted to blade 12. Pin 64 provides the pivotable securement of screwdriver attachment 30. Pin 64 passes through a hole 66 in screwdriver attachment 30. Hole 66 is substantially equal in diameter to pin 64 and allows screwdriver attachment 30 to pivot about the axis of pin 64. Pin 64 is secured into a hole 68 on blade 12. Screwdriver attachment 28 is similarly mounted on blade 12 through pin 80 and holes 82 and 84.

Screwdriver attachments 28 and 30 are lockable into several positions as shown by the dashed and solid lines of FIG. 4. A spring 70 provides an urging force upon screwdriver attachments 28 and 30 which ultimately secures their rotation.

Spring 70 is secured upon blade 12 through the use of pins 72 and 74. In this configuration spring 70 provides an urging force, as illustrated by arrows 96 and 98, upon the flat edge surface 76 or the flat edge surface 78 of screwdriver attachment 30. Similarly, spring 70 provides an urging force upon the flat edge surface 86 or the flat edge surface 88 of screwdriver attachment 28.

Figure 5:
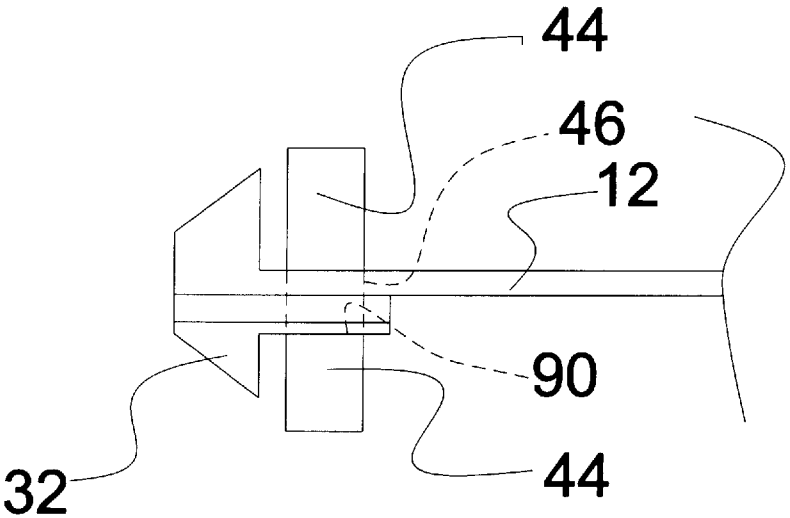
FIG. 5 is a detailed cross-sectional view of the tool showing the construction of the hammer head.

Referring now to FIG. 5, the mounting of hammer head end 32 to blade 12 is illustrated. Hammer head end 32 is secured to blade 12 by cylinder 44. Cylinder 44 passes through a hole 90 in hammer head and hole 46 of blade 12.

Figure 6:
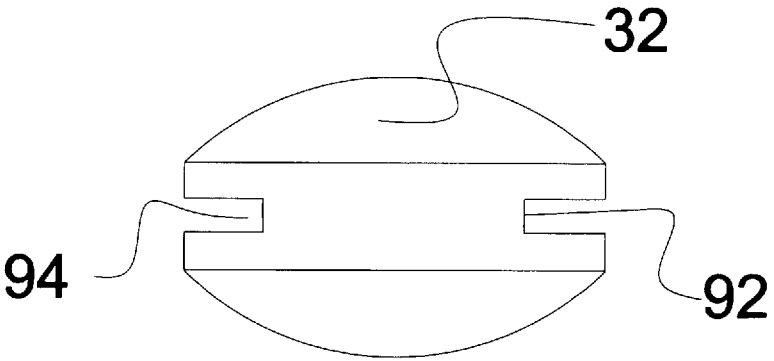
FIG. 6 is an end view of the hammer head.

Referring now to FIG. 6, an end view of hammer head end 32 is illustrated. Hammer head end 32 has cut out portions 92 and 94 which provide an upper limit to pivotal movement of screwdriver attachments 28 and 30. In this regard, the pivotal movement of screwdriver attachments 28 and 30, is limited.

As shown in FIGS. 4 and 6, the upper limit of the pivotal screwdriver attachments 28 and 30 is shown. The upper limit is reached when in-conjunction with spring 70 providing an urging force upon surface 78 and/or 88 of screwdriver attachments 28 and 30, the sides 100 and 102 of screwdriver attachments 28 and 30 will make contact with cut out portions 92 and 94 thereby defining the maximum pivot of screwdriver attachments 28 and 30.

Figure 7:
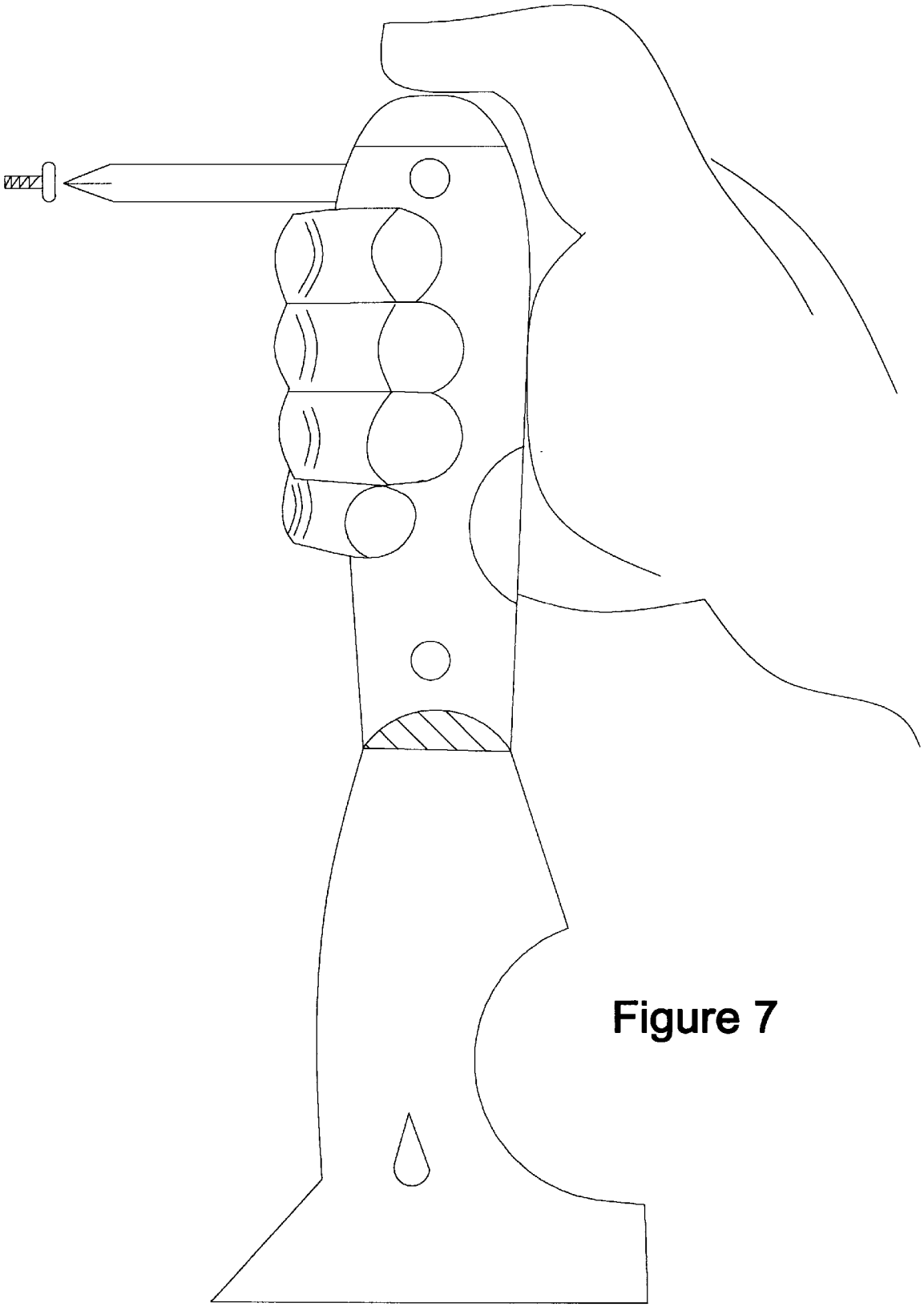
FIG. 7 is a plan view of the present invention in use driving a screw.
Figure 8:
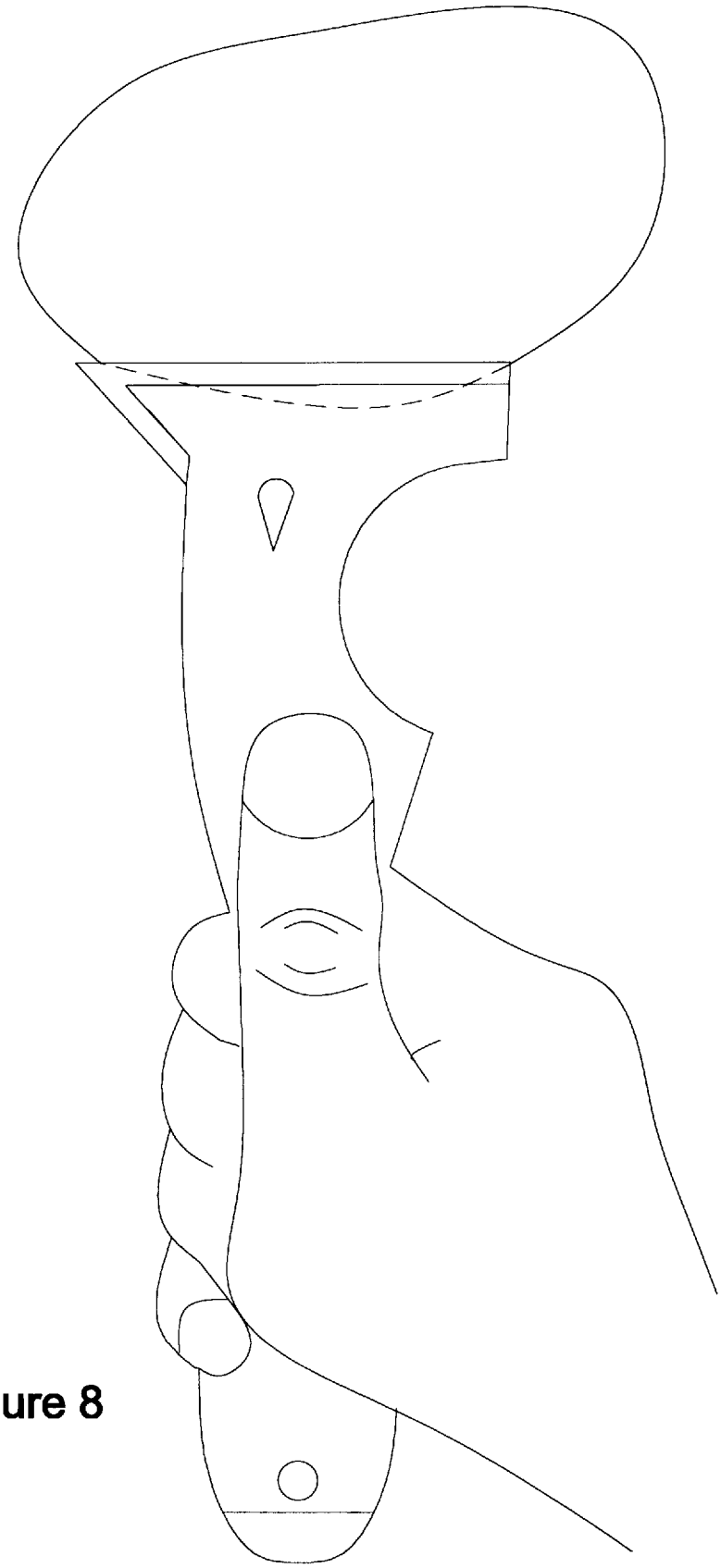
FIG. 8 is a plan view of the of the present invention in use as a spackle spreader.

FIGS. 7 and 8 illustrate various gripping configurations in which utility tool 10 can be used. These configurations allow optimum use of utility tool 10 without detracting from the usefulness of each aspect of the utility tool.

Figure 9:
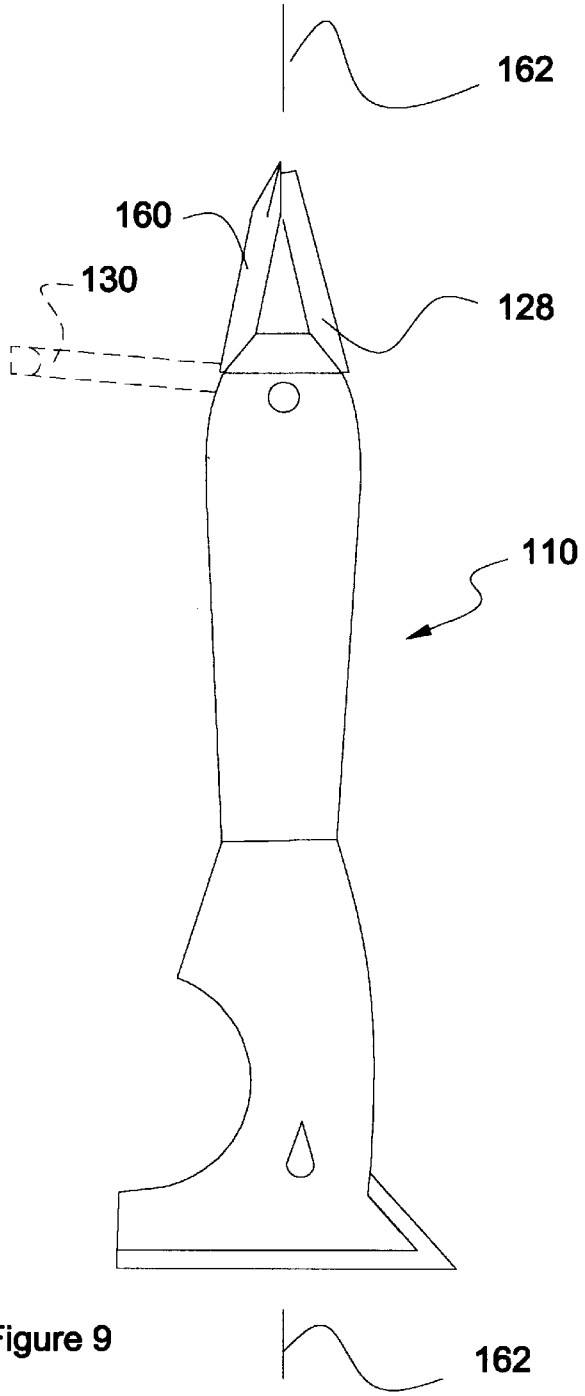
FIG. 9 is a top plan view of an alternative embodiment of the present invention.
Figure 10:
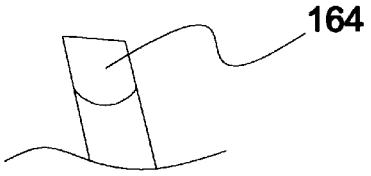
FIG. 10 is a detail of the FIG. 9 embodiment.
Figure 11:
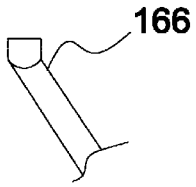
FIG. 11 is a detail of an alternative screwdriver head.

FIG. 9, illustrates an alternative embodiment of the present invention 110 wherein rotatable screwdriver attachments 128 and 130 lock at an end position 160 along the center axis 162 to provide a rotation about the axis of the utility tool. The tip of regular screwdriver attachment 130 is diagonally cut to provide a square edge surface when screwdriver attachment 130 is at end position 160. Similarly, Phillips head screwdriver attachment 128, is also diagonally cut to provide a square edge surface when screwdriver attachment 128 is at end position 160. The tip 164 of regular screwdriver 130 is shown in FIG. 10. Yet another alternative screwdriver attachment 166, this one with a bent shank, is illustrated in FIG. 11. similarly, screwdriver attachment 128, is also provided with a bent shank.

INDUSTRIAL APPLICABILITY

The present invention can be constructed in accordance with modern industrial processes. The present invention is also designed to be able to assembled from several prefabricated parts which can be manufactured using conventional techniques. This allows quick and efficient assembly.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A. multipurpose painter's utility tool comprising:

a) a blade, said blade having a first end and a second end, said first end defining a scraper portion and a nail pulling aperture;

b) a handle attached to said blade;

c) a pivotally mounted screwdriver attachment fastened on said blade, said pivotally mounted screwdriver attachment comprising a shank with a screwdriver tip defined at one end and a pivot mounting at the other end, said shank defining at least one flat surface proximate to said other end;

(d) a spring for providing an urging force to maintain positions of said screwdriver attachment corresponding to the position of said shank where said flat end meets said spring;

(e) a hammer head portion fastened to said second end of said blade, said hammer head portion (f) a channel for receiving said shank, said channel being positioned in said handle and extending through said hammer head portion, said channel defining a maximum point of pivot of said shank.

2. A multipurpose painter's utility tool as in claim 1, wherein said pivotally mounted screwdriver attachment defining a notched surface proximate to said other end, said notched surface communicating with said spring to maintain positions of said screwdriver attachment corresponding to the position of said notched surface where said surface meets said spring.

3. A multipurpose painter's utility tool as in claim 1, wherein said urging force provides alternative positions with respect to said blade, said alternative positions are either substantially orthogonal or substantially traverse with respect to the axis of said tool.

4. A multipurpose painter's utility tool as in claim 3, wherein said screwdriver attachment comprises a Phillips head type screwdriver.

5. A multipurpose painter's utility tool as in claim 3, wherein said screwdriver attachment comprises a flat head type screwdriver.

6. A multipurpose painter's utility tool as in claim 3, wherein a portion of said blade defines a concave edge portion, a square edge portion, and a pointed edge portion.

7. A multipurpose painter's utility tool as in claim 6, wherein said scraper portion is beveled on one side of said blade.

8. A multipurpose painter's utility tool as in claim 7, wherein said pointed edge portion is beveled on one side of said blade.

9. A multipurpose painter's utility tool as in claim 8, wherein said nail pulling aperture is located substantially in the center of said blade juxtaposed said scraper portion.

10. A multipurpose painter's utility tool as in claim 9, wherein said handle portion, said blade, and said hammer portion are in alignment with an aperture, said aperture being located substantially in the center of said blade juxtaposed said hammer head portion, said aperture provides for securement of said utility tool providing for convenient access.

11. A multipurpose painter's utility tool as in claim 10, wherein said nail pulling aperture is located substantially in the center of said scraper.

12. A multipurpose painter's utility tool as in claim 11, wherein the tip of said screwdriver attachment is diagonally cut to provide a point of contact substantially along the central axis of said blade.

13. A multipurpose painter's utility tool as in claim 11, wherein said screwdriver attachment is bent along its shaft to provide a point of contact substantially along the central axis of said blade.

14. A multipurpose painter's utility tool as in claim 1, wherein said handle portion comprises, an upper portion and a lower portion, and wherein either of said handle portions has cutaway portions to provide access to said screwdriver attachment.

15. A multipurpose painter's utility tool comprising:

a) a blade, said blade having a first end and a second end, said first end defining:

i) a scraper portion;

ii) a concave edge surface portion;

iii) a square edge surface portion;

iv) a pointed edge surface portion; and v) a nail pulling aperture;

(b) a handle attached to said blade;

(c) a pair of pivotally mounted screwdriver attachments, said screwdriver attachments comprising;

i) a shank; and ii) a screwdriver tip defined at one end and a pivot mounting at the other end, said shank defining at least one flat surface proximate to said other end;

(d) a spring for providing an urging force, said force maintaining positions of said screwdriver attachments corresponding to the position of said attachments where said flat ends meet said spring;

(d) a hammer head portion fastened to said second end (e) a pair of channels for receiving said attachments, said channels being positioned on opposite side of said handle and extending through said hammer head portion, said channels defining a maximum point of pivot of said attachments.

16. A multipurpose painter's utility tool as in claim 15, wherein said urging force maintains alternative positions with respect to said blade, said positions are either substantially orthogonal or substantially traverse with respect to the axis of said blade.

17. A multipurpose painter's utility tool as in claim 16, wherein said scraper portion is beveled on one side of said blade.

18. A multipurpose painter's utility tool as in claim 16, wherein said pointed edge surface portion is beveled on one side of said blade.

19. A multipurpose painter's utility tool as in claim 18, wherein said nail pulling aperture is located substantially in the center of said blade juxtaposed said scraper portion.

20. A multipurpose painter's utility tool as in claim 19, wherein said nail pulling aperture is located substantially in the center of said scraper.

21. A multipurpose painter's utility tool as in claim 15, wherein said handle portion, said blade, and said hammer portion are in alignment with an aperture, said aperture being located substantially in the center of said blade juxtaposed said hammer head portion, said aperture is configured, positioned and dimensioned and to function to mount said utility tool.

22. A multipurpose painter's utility tool as in claim 21, wherein said handle portion comprises an upper portion and a lower portion wherein either of said handle portions has cutaway portions to provide access to said screwdriver attachment.

23. A multipurpose painter's utility tool as in claim 15, wherein said handle portion, said blade, and said hammer portion are in alignment with an aperture, said aperture being located substantially in the center of said blade juxtaposed said hammer head portion, said aperture provides for securement of said utility tool providing for convenient access.

24. A multipurpose painter's utility tool as in claim 23, wherein the tip of said screwdriver attachments are diagonally cut to provide a point of contact along the central axis of said blade.

25. A multipurpose painter's utility tool as in claim 23, wherein said screwdriver attachments are bent to align said screwdriver tips along the central axis of said blade.

26. A multipurpose painter's utility tool comprising:

a) a blade, said blade having first end and a second end, said first end defining a scraper portion and a nail pulling aperture;

b) a handle attached to said blade;

c) a pivotally mounted screwdriver attachment positioned at the end of said handle opposite said blade, said pivotally mounted screwdriver attachment comprising a shank with a screwdriver tip defined at one end and a pivot mounting at the other end, said shank defining an engagement surface proximate to said other end;

(d) a spring for providing an urging force to maintain positions of said screwdriver attachment corresponding to the position of said shank where said engagement surface meets said spring; and (e) a hammer head portion fastened to other end of said handle, said hammer head portion being formed out of metal and defining a groove for receiving and defining a point of maximum pivot of said shank.

* * * * *